US005377866A

United States Patent [19]

Watters, II

[11] Patent Number: 5,377,866

[45] Date of Patent: Jan. 3, 1995

[54] MULTIPLE-ROLL TOILET PAPER DISPENSER RACK

[76] Inventor: William R. Watters, II, 407 Pine St., Clayton, N. Mex. 88415

[21] Appl. No.: 178,007

[22] Filed: Jan. 6, 1994

[51] Int. Cl.[6] ..... G07F 11/28

[52] U.S. Cl. ..... 221/194; 221/196; 221/249; 221/251; 221/256; 221/265; 221/266; 221/283; 312/45; 242/561; 242/598.3

[58] Field of Search ..... 221/191, 193, 194, 195, 221/196, 247, 249, 251, 255, 256, 283, 263, 265, 266, 281, 289, 294; 312/45; 211/44, 45; 242/55.2, 55.3, 55.53

[56] References Cited

U.S. PATENT DOCUMENTS 2,606,724 8/1952 Hertz ..... 242/55.53
2,852,327 9/1958 Mason ..... 221/283 X
3,743,137 7/1973 Bennett ..... 221/289
5,197,611 3/1994 Walton ..... 312/45 X

*Primary Examiner*—Robert P. Olszewski
*Assistant Examiner*—Dean A. Reichard

[57] ABSTRACT

A new and improved multiple-roll toilet paper dispenser rack for storing a plurality of rolls of toilet paper within the unused space of a bathroom cabinet and dispensing the rolls one at a time through an opening in the cabinet, the multiple-roll toilet paper dispenser rack comprising an elongated shallow pan having an inside width essentially the same as the width of a toilet paper roll, the shallow pan having a length substantially greater than the diameter of a toilet paper roll wherein a plurality of rolls may be placed, the shallow pan being fixedly mounted at a slight downward incline inside a bathroom cabinet adjacent to an opening through the cabinet wherethrough toilet paper rolls may be dispensed.

3 Claims, 4 Drawing Sheets

MULTIPLE-ROLL TOILET PAPER DISPENSER RACK

BACKGROUND OF THE INVENTION

1. Field of the Invention

The present invention relates to toilet paper dispensers and more particularly pertains to multiple-roll toilet paper dispenser racks which may be used for storing a plurality of rolls of toilet paper within the unused space of a bathroom cabinet and dispensing the rolls one at a time through an opening in the cabinet.

2. Description of the Prior Art

The use of multiple-roll toilet paper dispenser racks is known in the prior art. More specifically, multiple-roll toilet paper dispenser racks heretofore devised and utilized for the purpose of storing a plurality of rolls of toilet paper are known to consist basically of familiar, expected and obvious structural configurations, notwithstanding the myriad of designs encompassed by the crowded prior art which have been developed for the fulfillment of countless objectives and requirements.

The present invention is directed to improving devices for storing a plurality of rolls of toilet paper in a manner which is safe, secure, economical and aesthetically pleasing.

For example, U.S. Pat. No. 4,205,802 to Economakis discloses a multiple roll toilet tissue dispenser for storing a plurality of rolls of toilet tissue in vertically disposed compartments, and dispensing tissue from either of the rolls as desired; the toilet tissue dispenser provides convenient, multiple rolls of toilet tissue. A dispenser in accordance with the invention can be used in existing toilet tissue dispensing wells commonly found in the home and installed without need for any additional fixtures of tools. The invention disclosed above, when used as described, substantially projects from the bathroom wall near the toilet, an area having little free space in many normal size bathrooms, which could interfere with comfortable placement of a user's knees or elbows.

U.S. Pat. No. 4,314,679 to Paul et al. describes a roll-theft preventing roll holder and dispenser comprising a vertically disposed box for stacking a plurality of rolls one on top of the other therein, the device having a one-way filling aperture at the top, a one-way interior roll separating flange, and a narrow dispensing aperture at the bottom. The roll holder and dispenser described, because of its nature of construction, is difficult to clean and sanitize; also, the invention projects well beyond its mounting surface thereby being a potential hazard for snagging a user's clothing or jewelry.

The prior art also discloses a multiple tissue roll dispenser as shown in U.S. Pat. No. 3,474,977 to Mott et al. which consists of spaced fluted guides mounted in a tissue dispenser housing adjacent an opening for a tissue roll and longitudinally relative to the housing. The fluted guides and rotatable pivotal stop members guide and position tissue roll spindles having fluted heads in the housing to position a lowermost tissue roll in the opening for use when and to position storage tissue rolls thereabove for use when the lowermost tissue roll is depleted. Actuation of a spring loaded bar member releases the lowermost spindle and positions the next adjacent uppermost spindle and tissue roll in the opening for use thereof as desired.

U.S. Pat. No. 4,520,968 to Shpigeleman discloses a dispensing device for cylindrical bodies, such as rolls of toilet paper, paper towels and the like in which a plurality of rolls are stacked vertically in a magazine. A dispensing and holding mechanism comprises a cylindrical body mounted within the magazine body and below the stack. The body has a central axle and two radially extending arms biased toward one another by tension springs, the arms each have an oppositely directed stud adapted to enter the hollow core of a roll. The cylindrical body has opposed circular ends forming a number of cam paths, the roll supporting radial arms extending across and in contact with a respective one of the cam paths and being urged towards the opposite cam paths by the tension spring for imparting rotating movement to the cylindrical body about its central axis to deliver a roll from the vertical stack to a dispensing position.

The inventions disclosed in the U.S. Patents, above, are overly complex in construction leading to a high cost to manufacture.

Lastly, U.S. Pat. No. 306,810 to Michaud shows the ornamental design of a holder for multiple toilet paper rolls consisting of a horizontal shelf for fastening to a vertical surface, the shelf having a pair of upstanding spindles thereon.

In this respect, the multiple-roll toilet paper dispenser rack according to the present invention substantially departs from the conventional concepts and designs of the prior art, and in so doing provides an apparatus primarily developed for the purpose of storing a plurality of rolls of toilet paper within the unused space of a bathroom cabinet and dispensing the rolls one at a time through an opening in the cabinet.

Therefore, it can be appreciated that there exists a continuing need for new and improved multiple-roll toilet paper dispenser racks which can be used for storing a plurality of rolls of toilet paper. In this regard, the present invention substantially fulfills this need.

As illustrated by the background art, efforts are continuously being made in an attempt to develop devices to store a plurality of rolls of toilet paper. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of multiple-roll toilet paper dispenser racks now present in the prior art, the present invention provides an improved multiple-roll toilet paper dispenser rack construction wherein the same can be utilized for storing a plurality of rolls of toilet paper within the unused space of a bathroom cabinet and dispensing the rolls one at a time through an opening in the cabinet. As such, the general purpose of the present invention, which will be described subsequently in greater detail, is to provide a new and improved multiple-roll toilet paper dispenser rack apparatus and method which has all the advantages of the prior art multiple-roll toilet paper dispenser rack and none of the disadvantages.

The invention is defined by the appended claims with the specific embodiment shown in the attached drawings. For the purpose of summarizing the invention, the invention may be incorporated into a new and improved multiple-roll toilet paper dispenser rack for storing a plurality of rolls of toilet paper within the unused space of a bathroom cabinet and dispensing the rolls one at a time through an opening in the cabinet. The multiple-roll toilet paper dispenser rack comprises an elongated shallow pan of smooth rigid material such as plastic or metal having a front, a back, sides, a bottom, and an open top. The pan has an inside width essentially the same as the width of a standard toilet paper roll and a length substantially longer than the diameter of a toilet paper roll wherein a plurality of rolls may be placed. The pan sides, front, and back have exposed top edges, the sides also have a plurality of integral planar mounting tabs extending downwardly therefrom. The mounting tabs have a hole therethrough wherethrough a mounting screw may extend. The mounting tabs are coplanar with the sides whereby the dispenser rack may be mounted flush against an inside surface of a cabinet side panel at an incline whereby the toilet paper rolls will roll toward the front of the pan by the force of gravity. The top edge of each side also has identical semicircular notches formed thereon. The notches are opposite each other and located near the front of the pan nearest the cabinet opening whereupon a toilet paper roll spindle may be removedly engaged whereby the roll may be revolvedly retained on the dispenser rack for unrolling and dispensing individual sheets of paper.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved multiple-roll toilet paper dispenser rack for storing a plurality of rolls of toilet paper within the unused space of a bathroom cabinet and dispensing the rolls one at a time through an opening in the cabinet, the multiple-roll toilet paper dispenser rack comprising: an elongated shallow pan having an inside width essentially the same as the width of a toilet paper roll, the shallow pan having a length substantially greater than the diameter of a toilet paper roll wherein a plurality of rolls may be placed, the shallow pan being fixedly mounted at a slight downward incline inside a bathroom cabinet adjacent to an opening through the cabinet wherethrough toilet paper rolls may be dispensed.

It is another object of the present invention to provide a new and improved multiple-roll toilet paper dispenser rack which may be easily and efficiently manufactured and marketed.

It is a further object of the present invention to provide a new and improved multiple-roll toilet paper dispenser rack which is of a durable and reliable construction.

An even further object of the present invention is to provide a new and improved multiple-roll toilet paper dispenser rack which is susceptible of a low cost of manufacture with regard to both materials and labor, and which accordingly is then susceptible of low prices of sale to the consuming public, thereby making such multiple-roll toilet paper dispenser rack economically available to the buying public.

Still yet another object of the present invention is to provide a new and improved multiple-roll toilet paper dispenser rack which provides in the apparatuses and methods of the prior art some of the advantages thereof, while simultaneously overcoming some of the disadvantages normally associated therewith.

Still yet another object of the present invention is to provide a new and improved multiple-roll toilet paper dispenser rack which can be provided with new bathroom cabinets as well as retrofitted to existing cabinets.

Yet another object of the present invention is to provide a new and improved multiple-roll toilet paper dispenser rack which is simple to clean and maintain in a sanitary condition.

Even still another object of the present invention is to provide a new and improved multiple-roll toilet paper dispenser rack that uses the normally wasted space in the top of a bathroom cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
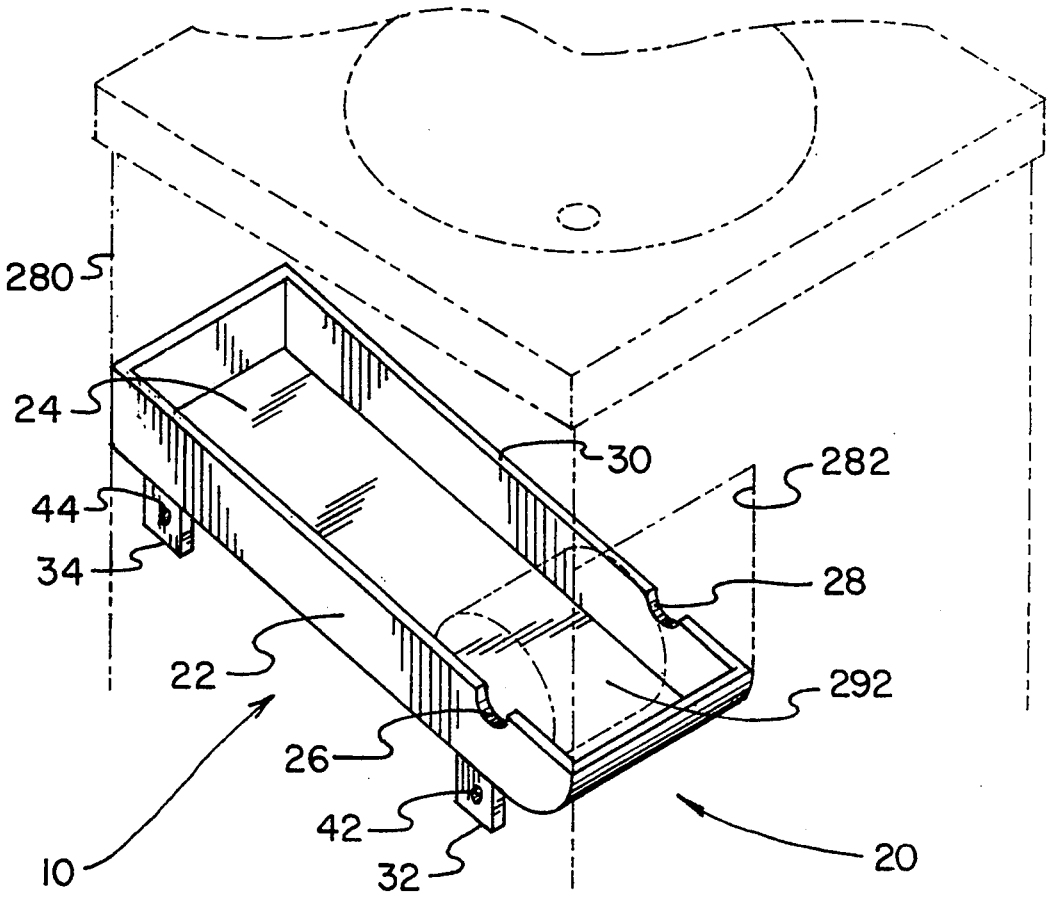
FIG. 1 is a perspective view of the present invention shown installed in a typical bathroom vanity cabinet.
Figure 2:
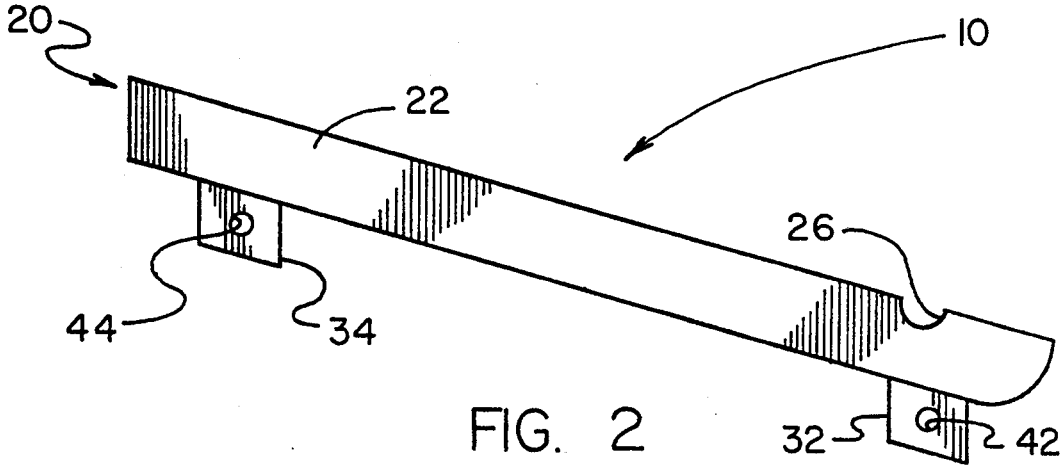
FIG. 2 is a side elevational view of the invention of FIG. 1.
Figure 3:
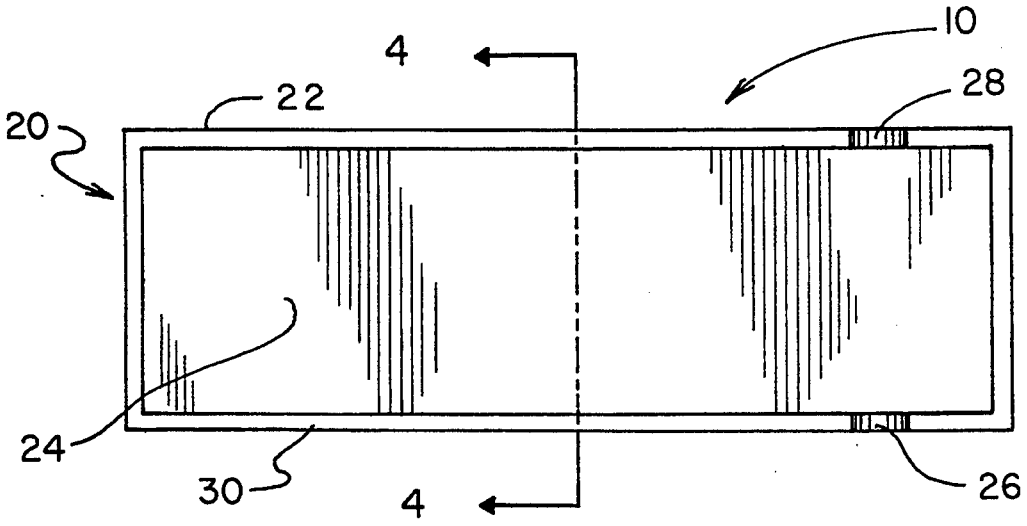
FIG. 3 is a top plan view of the invention of FIG. 1.
Figure 4:
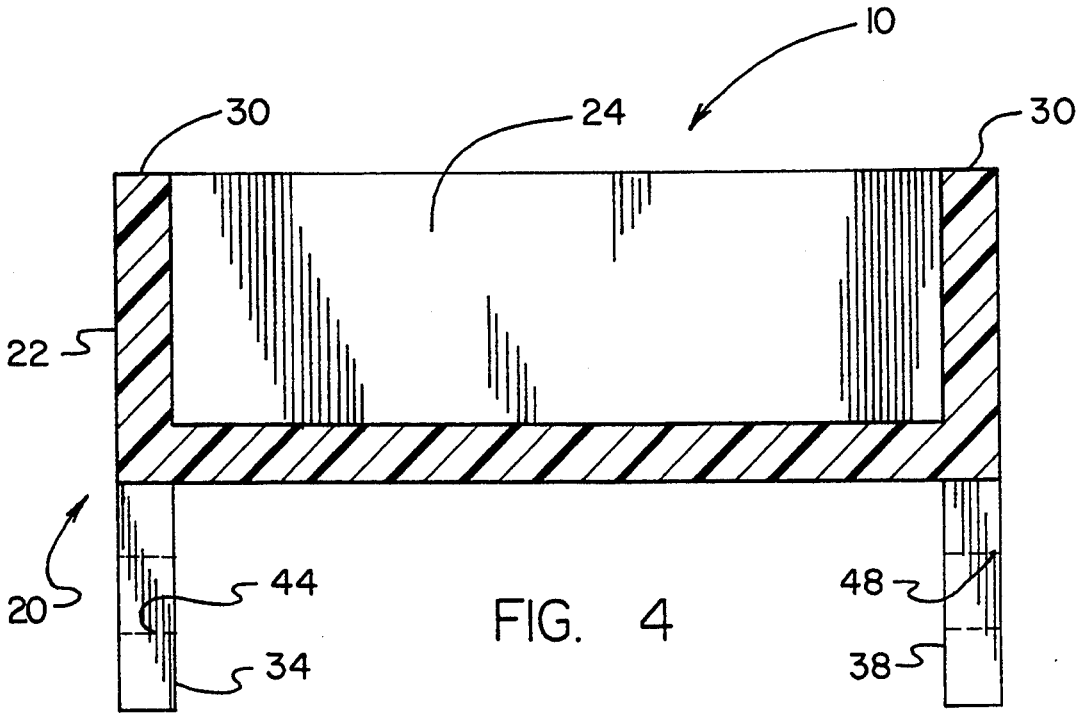
FIG. 4 is a sectional view of the invention of FIG. 3 taken along the line 4—4.

With reference now to the drawings, and in particular to FIG. 1 thereof, a new and improved multiple-roll toilet paper dispenser rack embodying the principles and concepts of the present invention and generally designated by the reference numeral 10 will be described.

From an overview standpoint, the multiple-roll toilet paper dispenser rack is adapted for use for storing a plurality of rolls of toilet paper within the unused space of a bathroom cabinet and dispensing the rolls one at a time through an opening in the cabinet. See FIG. 1.

With reference now to FIGS. 1 through 4, more specifically, it will be noted that a multiple-roll toilet paper dispenser rack 10 for storing a plurality of rolls of toilet paper within the unused space of a bathroom cabinet 280 and dispensing the rolls one at a time through an opening 282 in the cabinet is disclosed. The multiple-roll toilet paper dispenser rack 10 comprises an elongated shallow pan 22 of smooth rigid material such as plastic or metal having a front, a back, sides, a bottom, and an open top.

The pan 22 has an inside width essentially the same as the width of a standard toilet paper roll 292 and a length substantially longer than the diameter of a toilet paper roll whereby a plurality of rolls may be placed therein. The pan 22 sides, front, and back have exposed top edges 30, and the sides also have a plurality of integral planar mounting tabs 32, 34, and 38 extending downwardly therefrom.

The mounting tabs 32, 34, and 38 have a hole 42, 44, and 48 therethrough wherethrough a mounting screw (not shown) may extend. The mounting tabs 32, 34, and 38 are coplanar with the sides whereby the dispenser rack 10 may be mounted flush against an inside surface of a cabinet 280 side panel at an incline whereby the toilet paper rolls 292 will roll toward the front of the pan by the force of gravity.

The top edge 30 of the sides also have identical semicircular notches 26 and 28 formed thereon. The notches 26 and 28 are opposite each other and located near the front of the pan nearest the cabinet opening whereupon a toilet paper roll spindle (not shown) may be removedly engaged whereby the roll 292 may be revolvedly retained on the dispenser rack 10 for unrolling and dispensing individual sheets of paper.

Figure 5:
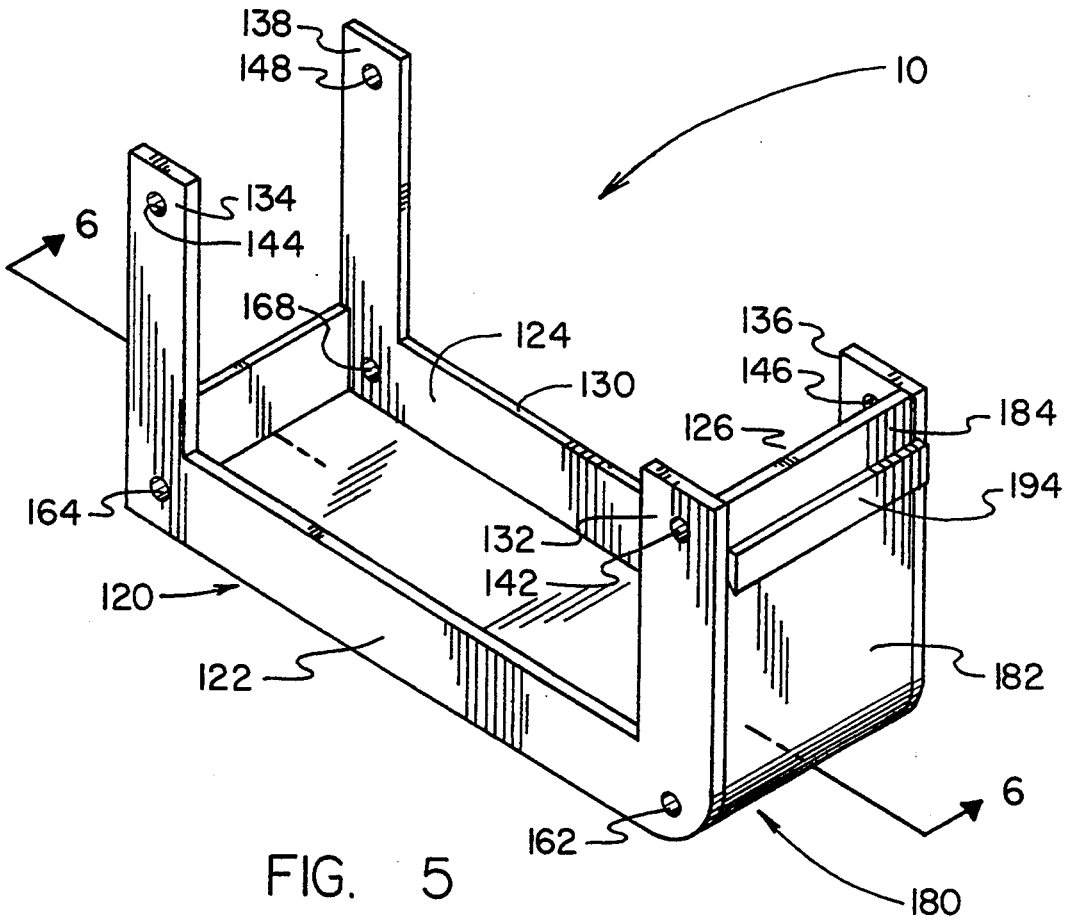
FIG. 5 is a perspective view of a first modification of the invention of FIG. 1 illustrating a pivoting dispenser door.
Figure 6:
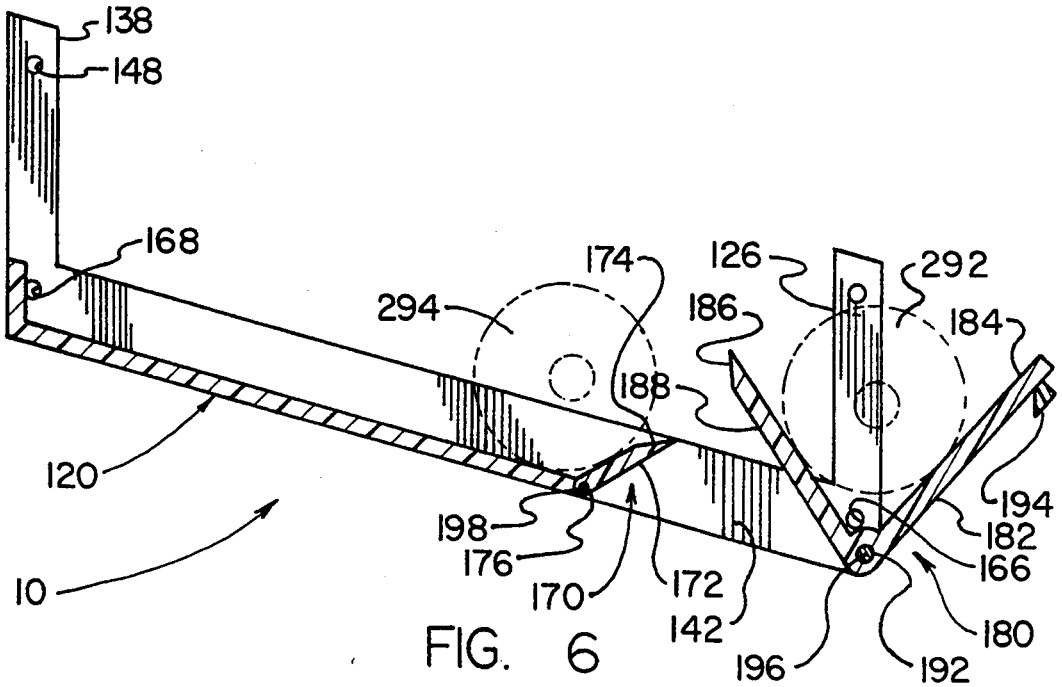
FIG. 6 is a sectional view of the invention of FIG. 5 taken along the line 6—6.

A first modification of the multiple-roll toilet paper dispenser rack 10 is shown in FIGS. 5 and 6, wherein the dispenser rack 10 includes a downwardly pivotable dispenser door means 180 whereby the rolls of toilet paper are hidden from view by a decorative door panel and rolls of paper are dispensed one at a time.

The dispenser door means 180 comprises an open-front shallow pan 120 having a partially open bottom 142 at the front and a plurality of integral planar mounting tabs 132,134,136, and 138 extending upwardly therefrom. The mounting tabs 132,134,136, and 138 have a length substantially greater than the diameter of a toilet paper roll 292 thereby controlling the minimum top clearance of the dispenser rack 10 during installation and ensuring the toilet paper rolls will not bind against an overhead surface during use.

The mounting tabs 132,134,136, and 138 have a hole 142, 144, 146, and 148 therethrough wherethrough a mounting screw (not shown) may extend. The mounting tabs 132, 134, 136, and 138 are also coplanar with the sides of the shallow pan whereby the dispenser rack 10 may be mounted flush against an inside surface of a cabinet side panel at an incline whereby the toilet paper rolls 292 and 294 will roll toward the front of the pan by the force of gravity.

The dispenser door means 180 also includes a first planar panel 182 hingedly connected at its bottom edge 196 within the open front 126 of the shallow pan 120 such that the first panel 182 opens pivotally downwardly. The first planar panel 182 extends the width and height of the front opening 126 of the shallow pan 120 so as to form a closure. The first planar panel 182 also has gripping handle means 194 fixedly connected thereto.

The dispenser door means 180 additionally includes an integral second planar panel 188 extending rearwardly from the bottom edge of the first planar panel 182 into the shallow pan 120. The second planar panel 188 has a width essentially the same as the inside width of the shallow pan. The second planar panel 188 forms a right angle with the first planar panel 182 so as to define a partial bottom for the open bottom 142 of the shallow pan when the door is closed whereupon a single roll of toilet paper 292 may sit. The bottom of the second planar panel 188 rear edge has a bevel 186 thereon.

The second planar panel 188 acts cooperatively with the first planar panel 182 to form a dispensing compartment 184 wherein the single roll of toilet paper 292 is picked up from the supply of rolls in the shallow pan and presented to the user upon opening the door. The dispenser door means 180 further has an upwardly pivotally spring biased finger 170 hingedly connected at one end 176 to the bottom of the shallow pan such that the toilet paper rolls 294 are prevented from rolling forward in the shallow pan when the door is open.

The finger 170 has a bevel 174 on its forward upper edge complimentary to the bevel 186 of the second planar panel 188 rear bottom edge. The finger 170 cooperates with the second planar panel 188 such that when its forward beveled edge 174 is contacted by the rear beveled edge 186 of the second planar panel 188 by the door being closed, the finger 170 is depressed to a flat position coplanar with the bottom of the shallow pan 120 thereby allowing a roll of toilet paper to roll forward onto the second planar panel 188 and into the dispensing compartment 184.

Figure 7:
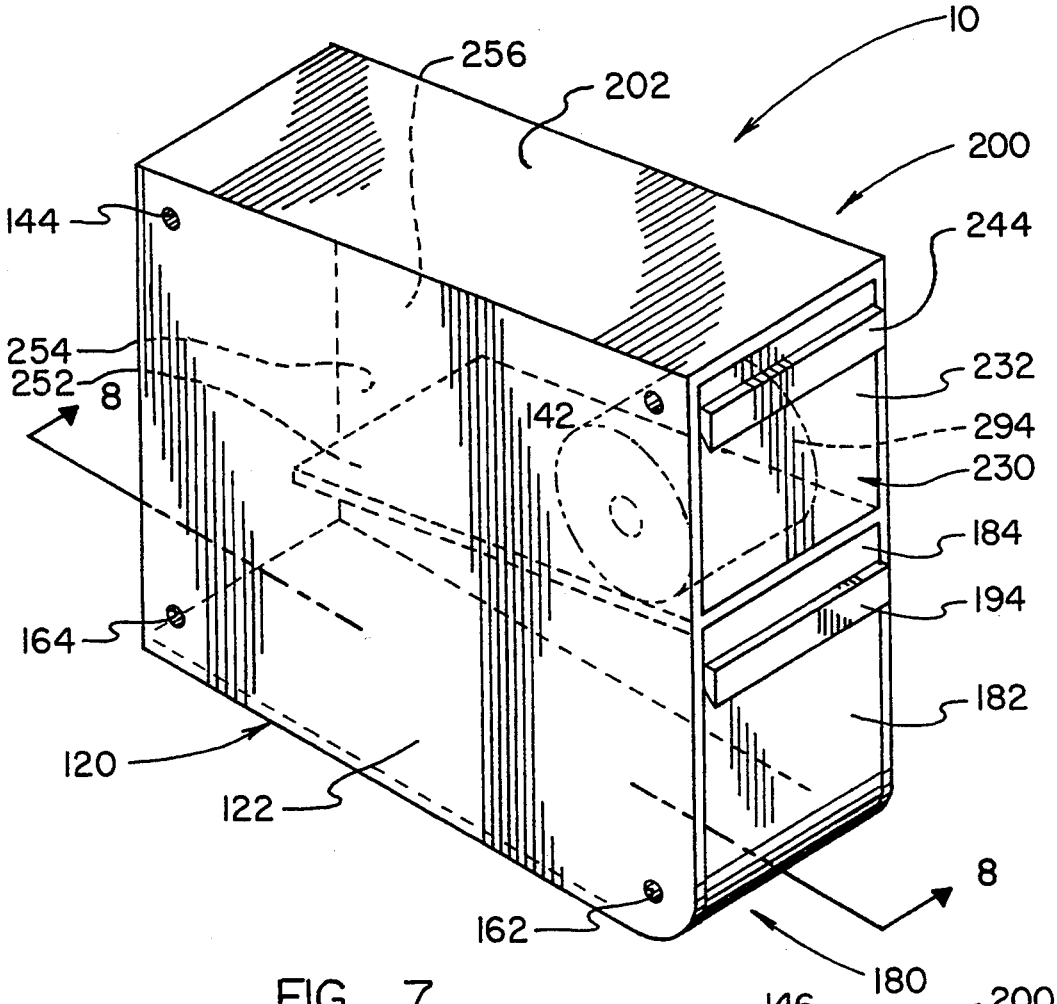
FIG. 7 is a perspective view of a second modification to the invention of FIG. 5 showing the added second storage compartment.
Figure 8:
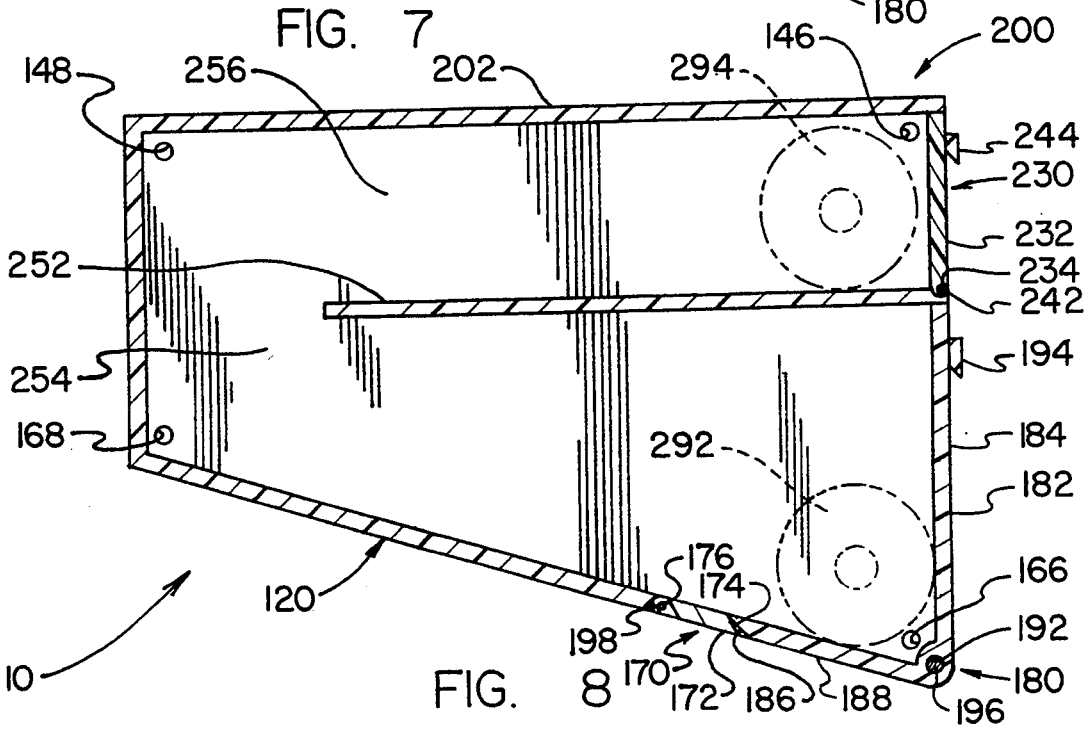
FIG. 8 is a sectional view of the invention of FIG. 7 taken along the line 8—8.

FIGS. 7 and 8 illustrate a second modification to the preferred embodiment of the multiple-roll toilet paper dispenser rack 10 which further includes a second compartment 256 for storing additional toilet paper rolls whereby the user needs to fill the dispenser rack 10 less frequently.

The second compartment 256 comprises a box 200 having a back, sides, and a top. The box 200 have a slightly downwardly sloping lateral partition 252 inside extending rearwardly from the front of the box above the dispenser door 180 to a point near the back of the box such that an opening 254 large enough for a toilet paper roll to fall through is formed.

The partition 252, together with the back, sides, and top, define an open-front storage compartment where additional rolls of toilet paper may be placed to be automatically fed by the force of gravity into the area below as other rolls are dispensed. The box 200 also has mounting holes 142, 144, 146, 148, 162, 164, 166, and 168 through the sides wherethrough a mounting screw (not shown) may extend.

The box 200 additionally has a downwardly pivotable door 230 hingedly connected at its bottom edge 234 to the bottom of The opening 232 in the front of the second compartment whereby a closure is formed. The downwardly pivotable door 230 has gripping handle means 244 whereby a user may open the door to add toilet paper rolls to the storage compartment.

As to the manner of usage and operation of the present invention, the same should be apparent from the above description Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved multiple-roll toilet paper dispenser rack for storing a plurality of rolls of toilet paper within the unused space of a bathroom cabinet and dispensing the rolls one at a time through an opening in the cabinet, the multiple-roll toilet paper dispenser rack comprising:

an elongated shallow pan of smooth rigid material such as plastic or metal having a front, a back, sides, a bottom, and an open top, the pan having an inside width essentially the same as the width of one of said plurality of rolls of toilet paper, the pan having a length substantially longer than a diameter of one of said plurality of rolls of toilet paper whereby a plurality of rolls may be placed therein, the sides, front, and back having exposed top edges, the sides also having a plurality of integral planar mounting tabs extending downwardly therefrom, the mounting tabs having a hole therethrough wherethrough a mounting screw may extend, the mounting tabs being coplanar with the sides whereby the dispenser rack may be mounted flush against an inside surface of a cabinet side panel at an incline whereby the toilet paper rolls will roll toward the front of the pan by the force of gravity, the top edge of each side also having identical semicircular notches formed thereon, the notches being opposite each other, the notches being located near the front of the pan nearest the cabinet opening whereupon a toilet paper roll spindle may be removedly engaged whereby the roll may be revolvedly retained on the dispenser rack for unrolling and dispensing individual sheets of paper.

2. The multiple-roll toilet paper dispenser rack of claim 1 wherein the dispenser rack includes a downwardly pivotable dispenser door whereby the rolls of toilet paper are hidden from view by a decorative door panel and rolls of paper are dispensed one at a time, the dispenser doors comprising:

a first planar panel hingedly connected at its bottom edge within the open front of the shallow pan such that the first panel opens pivotally downward, the first planar panel extending the width and height of the front opening of the shallow pan so as to form a closure, the first planar panel also having gripping handle means fixedly connected thereto;

an integral second planar panel extending rearwardly from the bottom edge of the first planar panel into the shallow pan, the second planar panel having a width essentially the same as the inside width of the shallow pan, the second planar panel forming a right angle with the first planar panel so as to define a partial bottom for an open bottom of the shallow pan when the door is closed whereupon a single roll of toilet paper may sit, the second planar panel acting cooperatively with the first planar panel to form a dispensing compartment wherein the single roll of toilet paper is picked up from the supply of rolls in the shallow pan and presented upon opening the door; and an upwardly pivotally spring biased finger hingedly connected to the bottom of the shallow pan such that the toilet paper rolls are prevented from rolling forward in the shallow pan when the door is opened, the finger having a length such that its forward edge is contacted by the rear edge of the second planar door panel when the door is closed forcing the finger against its biasing tension to lie flat thereby allowing a roll of toilet paper to roll forward onto the second planar panel and into the dispensing compartment.

3. The multiple-roll toilet paper dispenser rack of claim 2 and further including a second compartment for storing additional toilet paper rolls whereby the user will be required to fill the dispenser rack less frequently, the second compartment comprising:

a box having a back, sides, and a top, the box having a slightly downwardly sloping lateral partition inside extending rearwardly from the front of the box above the dispenser door to a point near the back of the box such that an opening large enough for a toilet paper roll to fall through is formed, the partition together with the back, sides, and top define an open-front storage compartment where additional rolls of toilet paper may be placed to be automatically fed by the force of gravity into the area below as other rolls are dispensed, the box also having mounting holes through the sides wherethrough a mounting screw may extend, the box additionally having a downwardly pivotable door hingedly connected at its bottom edge to the bottom of the opening in the front of the second compartment whereby a closure is formed, the downwardly pivotable door having gripping handle means whereby a user may open the door to add toilet paper rolls to the storage compartment.

* * * * *